US006233413B1

(12) United States Patent
Folkins

(10) Patent No.: US 6,233,413 B1
(45) Date of Patent: May 15, 2001

(54) SET-UP AND DIAGNOSIS OF PRINTING DEVICE ELECTROPHOTOGRAPHIC CLEANING STATION USING POTENTIAL MEASUREMENT

(75) Inventor: Jeffrey J. Folkins, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/329,873

(22) Filed: Jun. 11, 1999

(51) Int. Cl.[7] ..... G03G 15/00
(52) U.S. Cl. ..... 399/71; 399/72
(58) Field of Search ..... 399/34, 49, 71, 399/72

(56) References Cited

U.S. PATENT DOCUMENTS 5,175,584 * 12/1992 Usui ..... 399/71 X
5,493,381 * 2/1996 Lange et al. ..... 399/71 X
5,657,114 * 8/1997 Kitajima et al. ..... 399/71
5,666,590 9/1997 Folkins ..... 399/49
5,740,495 * 4/1998 Maher et al. ..... 399/71
5,749,019 * 5/1998 Mestha ..... 399/49 X
5,749,034 5/1998 Folkins ..... 399/303
5,761,579 6/1998 Folkins ..... 399/130
5,794,098 8/1998 Folkins ..... 399/50
5,839,016 11/1998 Folkins et al. ..... 399/46
5,848,335 12/1998 Folkins et al. ..... 399/186
5,903,796 * 5/1999 Budnik et al. ..... 399/49 X

* cited by examiner

*Primary Examiner*—Fred L. Braun
(74) *Attorney, Agent, or Firm*—John M. Kelly; David E. Henn

(57) ABSTRACT

Set-up and/or diagnostic routines for the cleaning stations of electrophotographic printing machines. The routines include the steps of charging a photoreceptor, exposing the charged photoreceptor to produce a test patch latent image, developing the test patch latent image to form a toner image, and then transferring the developed image onto a receiving surface. The test patch area is then subjected to the operation of a cleaning-related element, such as a pre-clean erase lamp or a pre-clean corotron. The potentials of the test patch are then measured without being disturbed or modified by subsequent processing steps. Based upon the measured potential, the cleaning-related element is adjusted to improve the cleaning process or diagnosed to determine whether it is operating.

18 Claims, 5 Drawing Sheets

SET-UP AND DIAGNOSIS OF PRINTING DEVICE ELECTROPHOTOGRAPHIC CLEANING STATION USING POTENTIAL MEASUREMENT

This invention relates to Recharge-Expose-and-Develop (REaD) electrophotographic printers. In particular it relates to setting-up and/or diagnosing cleaning stations using special machine cycles in which an electrostatic voltmeter measures the effects of the cleaning stations on the cleaning process and in which those readings are used to set-up and/or diagnose the cleaning process.

BACKGROUND OF THE INVENTION

Electrophotographic marking is a well-known and commonly used method of copying or printing documents. Electrophotographic marking is performed by exposing a light image representation of a desired document onto a substantially uniformly charged photoreceptor. In response to that light image the photoreceptor discharges, creating an electrostatic latent image of the desired document on the photoreceptor's surface. Toner particles are then deposited onto that latent image, forming a toner image. That toner image is then transferred from the photoreceptor onto a substrate such as a sheet of paper. The transferred toner image is then fused to the a substrate, usually using heat and/or pressure. The surface of the photoreceptor is then cleaned of residual developing material and recharged in preparation for the production of another image.

The foregoing broadly describes a black and white electrophotographic-printing machine. Electrophotographic marking can also produce color images by repeating the above process once for each color of toner that is used to make the composite color image. For example, in one color process, referred to herein as the REaD 101 process (Recharge, Expose, and Develop, Image On Image), a charged photoreceptive surface is exposed to a light image which represents a first color, say black. The resulting electrostatic latent image is then developed with black toner particles to produce a black toner image. The photoreceptor is then recharged, exposed, and developed using a second color, say yellow. The recharge, expose and develop process is then repeated for a third color, say magenta, and fmally for a fourth color, say cyan. The various color images are placed in superimposed registration so that a desired composite color image results. That composite color image is then transferred and fused onto a substrate.

The REaD IOI process can be implemented in various ways. For example, in a single pass printer wherein the composite fmal image is produced in a single pass of the photoreceptor through the machine. Other implementations require multiple passes of the photoreceptor through the various stations. For example, in a four-cycle printer only one color toner image is produced during each pass of the photoreceptor through the machine and wherein the composite color image is transferred and fused during the fourth pass. Another multiple pass implementation is in a two-cycle printer, wherein two different color toner images are produced during each of two pass of the photoreceptor through the machine and wherein the composite color image is transferred and fused during the last pass. REaD IOI can also be implemented in a five-cycle printer, wherein only one color toner image is produced during each pass of the photoreceptor through the machine, but wherein the composite color image is transferred and fused during a fifth pass.

An advantage of the multipass REaD/IOI processes is that they can be implemented at lower cost than the single pass REaD/IOI process. A multipass REaD/IOI system requires only one or two charging and exposure stations. Furthermore, at least in some configurations, a multipass REaD/IOI system can make multiple uses of various stations (such as using a charging station for transfer). Another advantage of multipass REaD/IOI systems it that they can be implemented with a small footprint (thus taking up less space on a desk).

Since exposing through an existing layer, developing over a developed layer, and transferring, fusing and cleaning multiple layers are more difficult than performing those tasks in non-REaD/IOI printers, and since the uniformity and quality requirements for color printing are generally more stringent than for black only printing, careful control of all processing steps in multipass REaD/IOI systems is critical. For example, if cleaning is performed incorrectly, or if the cleaning system is defective, residual debris and toner will contaminate subsequent images. Compounding the problem in REaD/IOI systems is the difficulty of transferring multiple toner layers. Poor transfer results in excess toner on the photoreceptor that the cleaning system must dispose of.

However, since low cost and small size are major advantages of REaD/IOI systems, the required process controls must be performed economically and without taking up an excessive amount of space. Therefore, a method of setting-up and diagnosing cleaning system components would be advantageous. Even more advantageous would be a method of setting-up and diagnosing cleaning system components that could be performed at low cost and that would not take up additional space.

SUMMARY OF THE INVENTION

In accordance with the principles of the present invention there is provided a method of setting-up and/or diagnosing cleaning system components in REaD/IOI systems. For set-up, that method includes the steps of producing a test patch on an area of the photoreceptor, transferring that test patch from the photoreceptor, exposing the test patch area to ions from a preclean corotron, measuring the test patch voltages, and adjusting the preclean corotron lamp or related element control parameter such that the desired operation is achieved. For diagnosis, the test patch potentials are used to determine whether the preclean corotron is operating. Beneficially, the foregoing process is performed using an undeveloped test patch and test patches produced by each developer, both singly for each individual color of toner, and collectively, wherein multiple colors of toner are deposited.

In addition, or alternatively, set-up includes the steps of producing a test patch on an area of the photoreceptor, transferring that test patch, exposing the test patch area to ions from a preclean corotron, exposing the test patch area to light from a preclean erase lamp, measuring the voltages on the test patch area, and adjusting the preclean erase lamp or related element control parameter such that the desired operation is achieved. For diagnosis, the test patch measurements are used to determine whether the preclean erase lamp is operating. Beneficially, the foregoing process is repeated using an undeveloped test patch and test patches produced by each developer, both singly for each individual color of toner, and collectively, wherein multiple colors of toner are deposited.

BRIEF DESCRIPTION OF THE DRAWINGS

Other aspects of the present invention will become apparent as the following description proceeds and upon reference to the drawings, in which.

DETAILED DESCRIPTION OF AN EMBODIMENT OF THE INVENTION

The preferred embodiment of the present invention includes a plurality of individual subsystems which are known in the prior art, but which are used in a novel, non-obvious, and useful way. While the illustrated embodiment is a 4 cycle REaD/IOI color electrophotographic printing machine, the present invention is not limited to such embodiments. Therefore, it is to be understood that the present invention is intended to cover all alternatives, modifications and equivalents as may be included within the scope of the appended claims.

Figure 1:
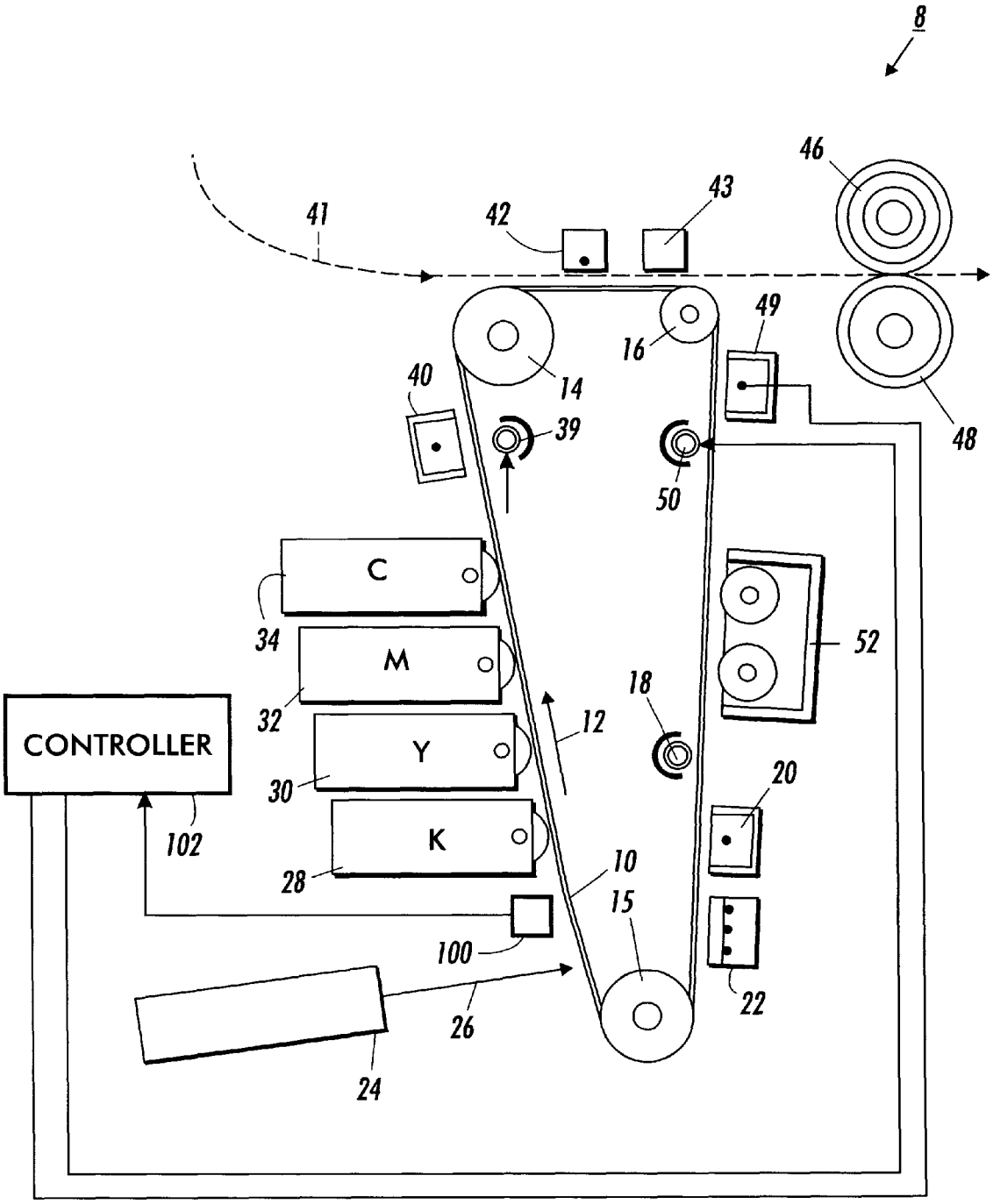
FIG. 1 is a schematic illustration of an electrophotographic-printing machine that incorporates the principles of the present invention.

To understand the principles of the present invention it is helpful to understand the operation of a color electrophotographic printer in some detail. Refer now to FIG. 1 for a schematic depiction of a color electrophotographic, multipass, Recharge-Expose-and-Develop (REaD), Image-on-Image (IOI) printing machine 8. That machine includes an Active Matrix (AMAT) photoreceptor belt 10 that travels in the direction indicated by the arrow 12. Belt travel is brought about by mounting the photoreceptor belt about a drive roller 14 (that is driven by a motor which is not shown) and tension rollers 15 and 16.

As the photoreceptor belt travels each part of it passes through each of the subsequently described process stations. For convenience, a single section of the photoreceptor belt, referred to as the image area, is identified. The image area is that part of the photoreceptor belt which is to receive the various toner layers which, after being transferred and fused to a substrate, produces the final color image.

In the printing machine 8 the production of a color document takes place in 4 cycles. The first cycle begins with the image area passing a "precharge" erase lamp 18 that illuminates the so image area so as to cause any residual charge which might exist on the image area to be discharged. Such erase lamps are common in high quality systems and their use for initial erasure is well known.

In the printing machine 8, with the direction of travel 12, and starting the first cycle at the erase lamp 18, two directions, upstream and downstream, can be defined. Downstream is moving toward the erase lamp in the direction 12. Upstream is moving toward the erase lamp opposite to the direction 12. Therefore the relative location of one object in the printing machine 8 can be specified as being upstream or downstream of another object. Additionally, the image area is not a point source; it has a length and a width. That fact and the motion of the photoreceptor result in the image area having a leading edge and a trailing edge, with the trailing edge being downstream of the leading edge. Finally, the upstream distance between the trailing edge and the leading edge of the next image area defines an inter-document zone.

As the photoreceptor belt continues its travel the leading edge of the image area enters a charging station consisting of a DC scorotron 20 and an AC scorotron 22. As the image area passes through the charging station the DC scorotron charges the image area to a substantially uniform potential of, for example, about −500 volts in preparation for creating a latent image for black toner. During this initial charging the AC scorotron 22 need not be used. However, using both the DC scorotron 20 and the AC scorotron 22 will usually give better charge uniformity. It should be understood that the actual charge placed on the photoreceptor will depend upon the machine design and many variables.

After passing the charging station the leading edge of the image area advances until it reaches an exposure station 24. As the charged image area passes through the exposure station the image area is raster scanned by a modulated laser beam 26 such that an electrostatic latent representation of a black image is produced. For example, illuminated sections of the image area might be discharged by the laser beam 26 to about −50 volts. Thus after exposure the image area has a voltage profile comprised of relatively high voltage areas (of say −500 volts) and of relatively low voltage areas (of say −50 volts).

After passing the exposure station 24 the leading edge of the exposed image area passes a black developer 28. As the exposed image area passes the black developer that developer deposits charged black toner particles onto the image area. The charged black toner adheres to the illuminated areas of the image area thereby causing the voltage of the illuminated parts of the image area to be about −200 volts. The non-illuminated parts of the image area remain at −500 volts. Beneficially the black developer 28 is a hybrid scavengeless developer.

After passing the black developer 28 the leading edge of the image area advances past a number of other stations (whose purposes are described subsequently) and returns to the precharge erase lamp 18. The second cycle then begins with recharging the photoreceptor. Numerous schemes for recharging the image area and its black toner layer are possible. One method is to use the precharge erase lamp 18 to expose the photoreceptor so as to reduce the charge on the unexposed areas of the image area. Then, the DC scorotron 20 recharges the image area to the charge level desired for exposure and development of the yellow image. Here, the AC scorotron 22 is not used. Of course many of the other recharging schemes can be used when implementing the principles of the present invention.

The leading edge of the recharged image area with its black toner layer then advances to the exposure station 24. That exposure station then exposes the image area with the laser beam 26 so as to produce an electrostatic latent representation of a yellow image. As an example of the charges on the image area, the non-illuminated parts of the image area might have a potential about −450 while the illuminated areas are discharged to about −50 volts. After passing the exposure station 24 the leading edge of the exposed image area advances past the black developer 28 to a yellow developer 30. As the leading edge of the image area passes the yellow developer that developer begins depositing yellow toner onto the image area.

After passing the yellow developer the leading edge of the image area again advances past the precharge exposure lamp and the third cycle begins. During the third (and fourth) cycle the charging station might use split recharging. In split recharging the DC scorotron 20 overcharges the image area and its toner layers to a more negative potential than that which the image area and its toner layers are to have when they are next exposed. For example, the image area may be charged to a potential of about −700 volts. The AC scorotron 22 then reduces the negative charge on the image area by applying positive ions so as to recharge the image area to the desired potential for the next exposure. Since the AC scorotron supplies positive ions to the toner layers some of the toner particles take positive charges or have their negative charges neutralized. An advantage of using an AC scorotron as the fmal charging device is that an AC scorotron has a high operating slope: a small voltage variation on the image area results in large charging currents. Beneficially, the voltage applied to the metallic grid of the AC scorotron 22 can be used to control the voltage at which charging currents are supplied to the image area. A disadvantage of using an AC scorotron is that it, like most other AC operated charging devices, tends to generate more ozone than comparable DC operated charging devices.

After passing the AC scorotron 22 the substantially uniformly charged image area with its two toner layers then advances once again to the exposure station 24. The exposure station again exposes the image area using the laser beam 26, this time with a light representation that discharges some parts of the image area to create an electrostatic latent representation of a magenta image. After passing the exposure station 24 the leading edge of the exposed image area advances past the black and yellow developers to a magenta developer 32. That developer begins depositing magenta toner onto the image area.

As the photoreceptor continues rotating the leading edge of the image area advances past the precharge erase lamp 18 to the charging station. The fourth cycle then begins. The DC scorotron 20 and the AC scorotron 22 again split recharge the image area (which now has three toner layers) to produce the desired charge on the photoreceptor. The leading edge of the substantially uniformly charged image area then advances once again to the exposure station 24. The exposure station exposes the image area again, this time with a light representation that discharges some parts of the image area to create an electrostatic latent representation of a cyan image. After passing the exposure station the leading edge of the image area advances to a cyan developer 34. As the image area passes the cyan developer that developer deposits cyan toner onto the image area.

After passing the cyan developer 34 the image area has up to four toner layers which together form a composite color toner image. That composite color toner image is comprised of individual toner particles that have charge potentials that vary widely. Indeed, some of those particles might have a positive charge. Transferring such a composite toner image onto a substrate would result in a degraded final image. Therefore it is beneficial to prepare the composite color toner image for transfer.

To prepare for transfer a pre-transfer erase lamp 39 discharges the image area as it passes so as to produce a relatively low charge level on the photoreceptor. The leading edge of the image area then passes a pre-transfer scorotron 40 that performs a pre-transfer charging function by supplying sufficient negative ions to the image area such that substantially all of the previously positively charged toner particles are reversed in polarity.

The leading edge of the image area continues to advance in the direction 12 past the driven roller 14. A substrate 41 is then placed over the image area using a sheet feeder (which is not shown). As the leading edge of the image area and the substrate continue their travel they pass a transfer corotron 42. That corotron applies positive ions onto back of the substrate 41. Those ions attract the negatively charged toner particles onto the substrate.

As the substrate continues its travel is passes a detack corotron 43. That corotron neutralizes some of the charge on the substrate to assist separation of the substrate from the photoreceptor 10. As the lip of the substrate moves around the tension roller 16 the lip separates from the photoreceptor. The substrate is then directed into a fuser where a heated fuser roller 46 and a pressure roller 48 create a nip through which the substrate 41 passes. The combination of pressure and heat at the nip causes the composite color toner image to fuse into the substrate. After fusing, a chute, not shown, guides the substrate to a catch tray, also not shown, for removal by an operator.

After the substrate is separated from the photoreceptor 10 the leading edge of the image area continues its travel and passes a preclean corotron 49. The preclean corotron sprays ions onto the residual toner and/or debris on the photoreceptor so as to convert all of the charges to the same polarity. After passing the preclean corotron the leading edge of the image area reaches a preclean erase lamp 50. That lamp exposes the image area so as to reduce the photoreceptor potentials. After passing the preclean erase lamp the residual toner and/or debris on the photoreceptor is removed at a cleaning station 52. At the cleaning station cleaning brushes wipe residual toner particles from the image area. This marks the end of the 4th cycle. The leading edge of the image area then passes once again to the precharge erase lamp and the start of another 4 cycles.

The foregoing has described an electrophotographic-printing machine in sufficient detail that the principles of the present invention can be clearly understood. In addition to the foregoing, the printing machine 8 also operates in a special cleaning system routine in which a document image is not produced, but in which one or more cleaning system components are set-up or diagnosed. The special routines are beneficially performed shortly after the printing machine 8 is initially turned on. Alternatively, or additionally, a special routine can be performed on other occasions, such as after a predetermined number of documents have been produced or upon demand by an operator.

Still referring to FIG. 1, the special cleaning system routine makes use of an electrostatic voltmeter 100 that reads the potential of the photoreceptor 10. Electrostatic voltmeters are well known and are commonly used in electrophotographic systems. Beneficially, the electrostatic voltmeter is located adjacent the photoreceptor, upstream of the exposure station 24 and downstream of the developers 28–34. This allows the electrostatic voltmeter to be used for purposes other than the present invention. That voltmeter applies its readings to a controller 102 that controls the operation of the various machine functions described above and below. The electrostatic voltmeter can also be placed elsewhere in along the photoreceptor as required, with the space after the cleaning station being another particularly good location.

Figure 2:
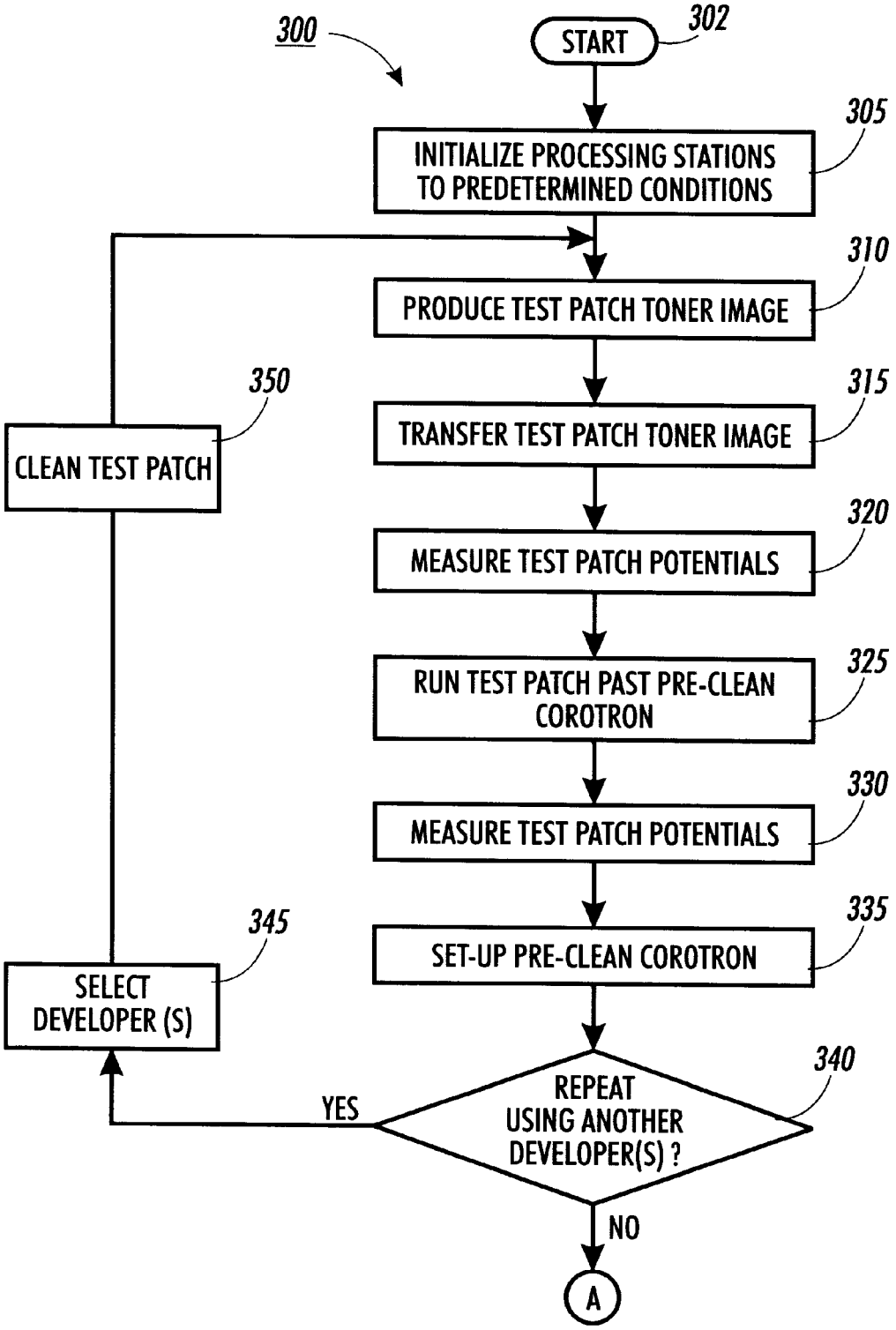
FIG. 2 is a flow diagram showing a cleaning set-up routine that is used in the electrophotographic-printing machine of FIG. 1.
Figure 3:
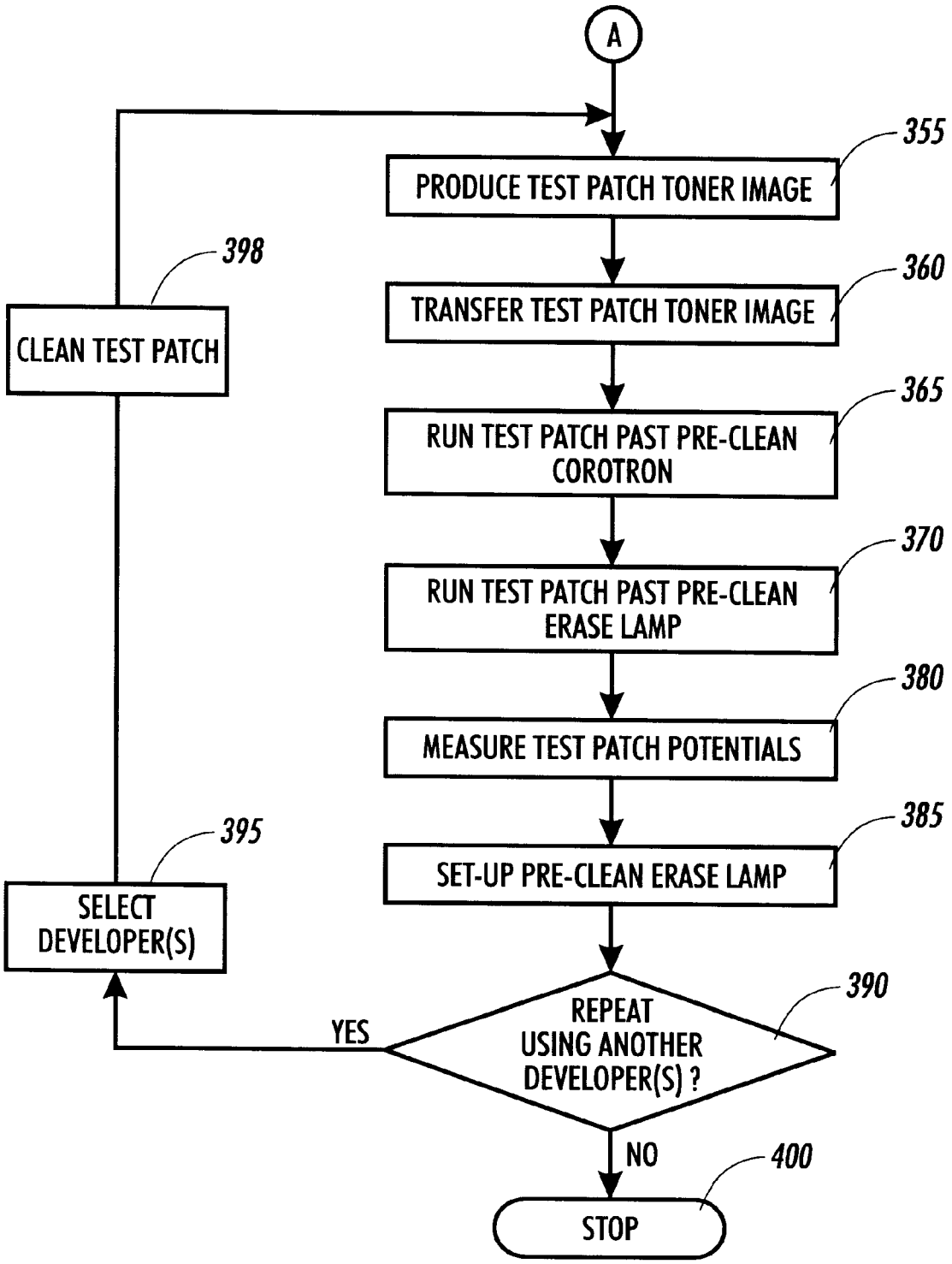
FIG. 3 is a continuation of the cleaning set-up routine of FIG. 2.

A special cleaning system routine is explained with the assistance of the block diagrams of FIGS. 2 and 3. The cleaning system routine 300 starts, step 302, by initializing the various processing stations of the electrophotographic printing machine 8 to predetermined conditions, step 305. For example, charger, exposure, developer, and transfer related stations might be set-up. After initialization, a test patch toner image is produced on the photoreceptor by exposing and developing a predetermined test patch area, step 310. That test patch toner image is then transferred onto a substrate, step 315. The test patch area is then advanced to the electrostatic voltmeter 100 and the test patch area potentials are then measured and stored for subsequent use, step 320. The test patch area is then advanced and ran past an operating pre-clean corotron 49, step 325. The test patch is then advanced to the electrostatic voltmeter and the test patch potentials are then re-measured, step 330. The results of the measurements are then used to set-up the pre-clean corotron, step 335. In practice a "look-up table" or a formula can be used to set-up the pre-clean corotron station based upon the differences in the measured electrostatic voltmeter readings. A decision is then made as to whether other developers are to be used to make test patch toner images, step 340. Using other developers enables "fine-tuning" of the pre-clean corotron set-up. The process of setting up the pre-clean corotron might be performed for the toners from each of the developers (black, cyan, magenta, and yellow) and for each basic color combination (yellow-magenta, yellow-cyan, magenta-cyan, and yellow-cyan-magenta). If another developer set-up is to be performed the developer(s) are selected, step 345, the test patch area is then cleaned by exposing the test patch with light from the pre-clean exposure lamp 50 and then cleaning using the cleaning station 52, step 350. The set-up routine then loops back to step 310.

After the pre-clean corotron is optimized, the set-up routine 300 continues by producing a test patch toner image, step 355. That test patch toner image is then transferred onto a substrate, step 360. The test patch area is then run past the set-up and operating pre-clean corotron 49, step 365. The test patch area is then advanced and ran past an operating pre-clean erase lamp 50, step 370. The test patch is then advanced to the electrostatic voltmeter and the test patch potentials are then measured, step 380. The measurement results are the used to set-up the pre-clean erase lamp, step 385. In practice a "look-up table" or a formula can be used to set-up the pre-clean erase lamp. A decision is then made as to whether other developers are to be used to make test patch toner images, step 390. Using other developers enables "fine-tuning" of the pre-clean erase lamp set-up. The process of setting up the pre-clean erase lamp might be performed for toners from each of the developers (black, cyan, magenta, and yellow) and for each basic color combination (yellow-magenta, yellow-cyan, magenta-cyan, and yellow-cyan-magenta). If another developer set-up is to be performed the developer(s) are selected, step 395, the test patch area is then cleaned using the cleaning station 52, step 398, and the set-up routine loops back to step 355. However, if no additional developers are to be used to produce test patches the subroutine 300 ends, step 400.

The pre-clean erase lamp measurement also might be performed with the pre-clean corotron disabled or in a system that does not include a pre-clean corotron. Additionally the machine could utilize the pre-clean erase lamp and the corotron in a reversed order wherein the erase function occurs before the corona function. The print machine also could utilize a pre-clean erase lamp and corotron that are situated such that their functions are intermixed and simultaneous. In this case the foregoing measurements could be made with all combinations of either using individual devices (e.g. an erase lamp turned on and the corona turned off and vice versa) or with simultaneous usage (e.g. with both the erase lamp and corotron turned on). It is also possible to configure the system with two erase lamps, one before and one after the corotron.

Figure 4:
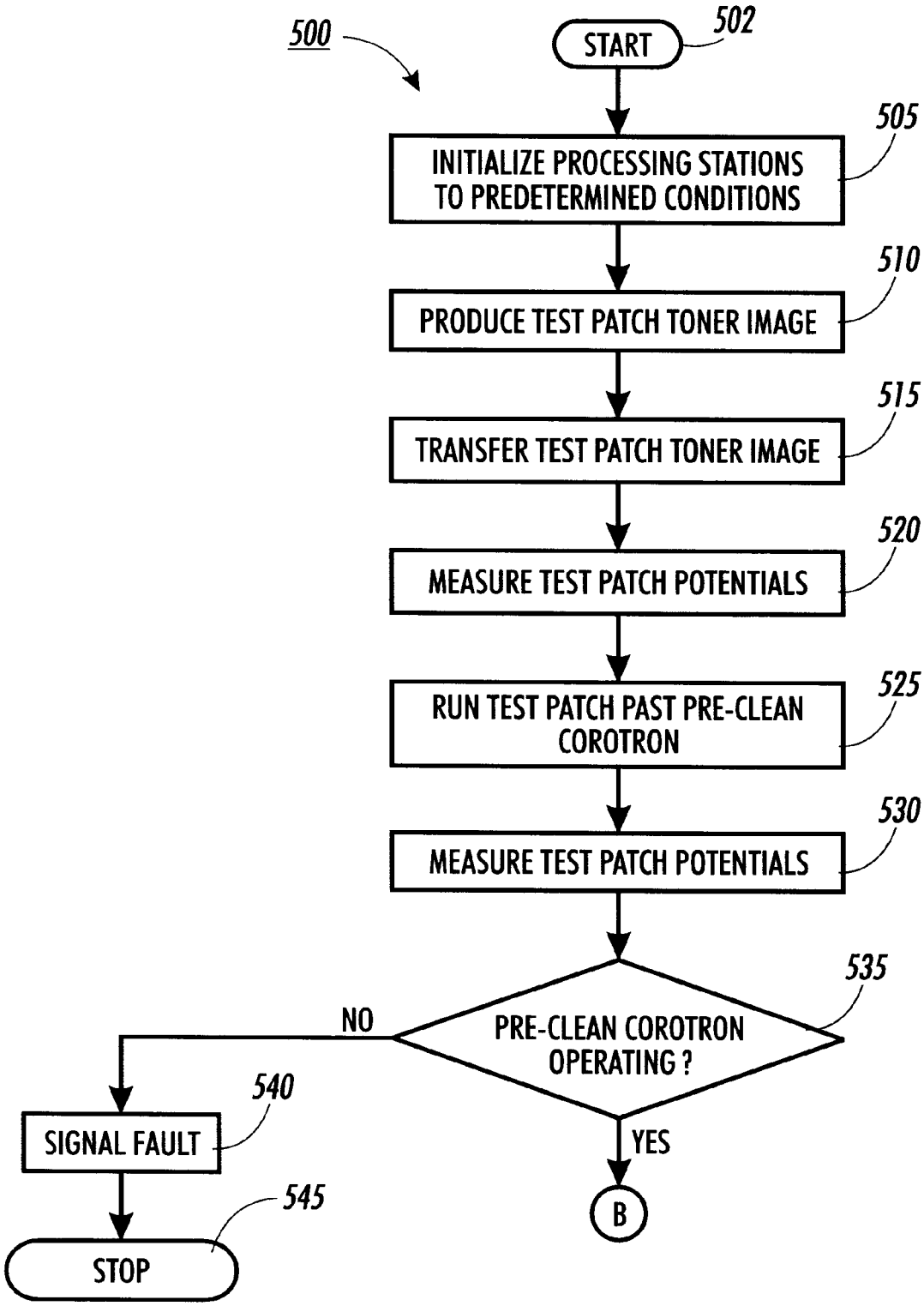
FIG. 4 is a flow diagram showing a cleaning diagnostic routine that is used in the electrophotographic-printing machine of FIG. 1.
Figure 5:
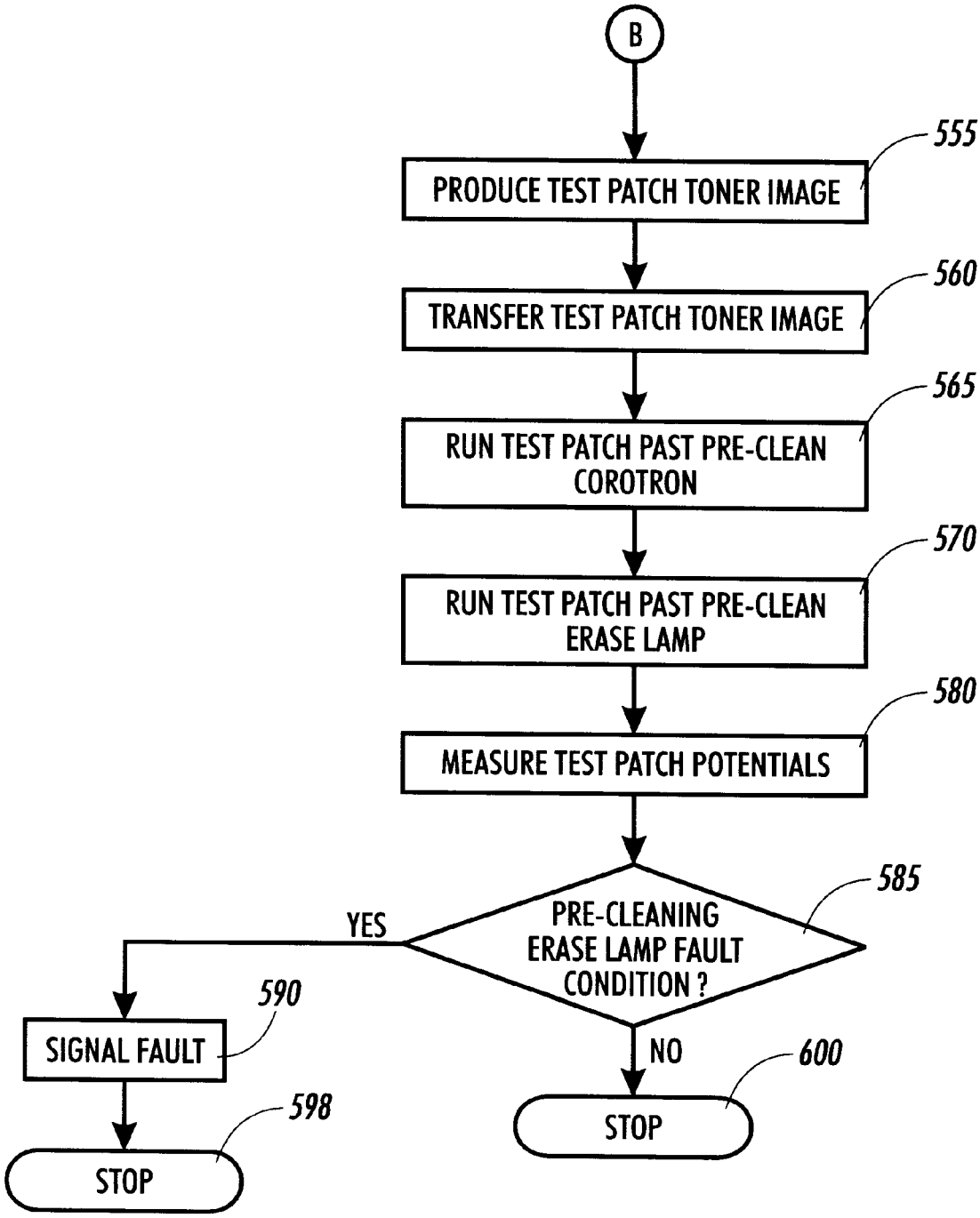
FIG. 5 is a continuation of the cleaning diagnostic routine of FIG. 4.

In addition to the special transfer set-up routine 300, the printing machine 8 includes a special cleaning diagnostic routine 500 that is explained with the assistance of the block diagrams of FIGS. 4 and 5. The transfer diagnostic routine 500 starts, step 502, by initializing the various processing stations of the electrophotographic printing machine 8 to predetermined conditions, step 505. After initialization, a test patch toner image is produced on the photoreceptor by exposing and developing a predetermined test patch area, step 510. That test patch toner image is then transferred onto a substrate, step 515. The test patch area is then advanced to the electrostatic voltmeter 100 and the test patch area potentials are then measured and stored for subsequent use, step 520. The test patch area is then advanced and ran past an operating pre-clean corotron 49, step 525. The test patch is then advanced to the electrostatic voltmeter and the test patch potentials are then re-measured, step 530. The results of the measurements are then used to determine whether the pre-clean corotron is operating, step 535. If a fault is determined the controller 102 signals (in some manner such as a flashing LED error indicator) a fault condition, step 540. The cleaning diagnostic routine then stops, step 545. However, if the pre-clean corotron is operating, the photoreceptor is recharged, another test patch is exposed and, using one of the development stations, developed, step 555. That test patch toner image is then transferred onto a substrate, step 560. The test patch area is then run past the operating pre-clean corotron 49, step 565. The test patch area is then advanced and ran past a now operating pre-clean erase lamp 50, step 570. The test patch is then advanced to the electrostatic voltmeter and the test patch potentials are then measured, step 580. The results of the measurements are then used to determine whether the pre-clean erase lamp is operating, step 585. If a fault condition is determined the controller 102 signals (in some manner such as a flashing LED error indicator) a fault condition, step 590. The cleaning diagnostic routine then stops, step 598. However, if a fault condition was not determined to exist in step 585 the cleaning diagnostic routine stops, step 600.

As with the diagnostic routines, it is possible to utilize various combinations of physical placements and enablements of the corona and erase functions.

It is to be understood that while the figures and the foregoing description illustrate the present invention, they are exemplary only. Others who are skilled in the applicable arts will recognize numerous modifications and adaptations of the illustrated embodiments that will remain within the principles of the present invention. For example any individual step described above may be performed separately. Similarly a variety of input treatments to the photoreceptor and patches (including untoned patches) may be used going into the device to be measured or adjusted. Therefore, the present invention is to be limited only by the appended claims.

What is claimed is:

1. A method of operating a printing machine comprising the steps of:

(a) producing a first known potential on a first test patch;

(b) advancing the first test patch past an operating transfer station and past a cleaning station;

(c) measuring the potential of the first test patch after step (b);

(d) producing a second known potential on a second test patch;

(e) illuminating the second test patch after step (d) with light from a cleaner erase lamp; and (f) measuring the potential of the second test patch after step (e).

2. The method of operating a printing machine according to claim 1, wherein the cleaning station of step (b) is an ion-producing corona source.

3. The method of operating a printing machine according to claim 2, further including a step of adjusting the corona source based upon the potential measured in step (c).

4. The method of operating a printing machine according to claim 1, further including a step (g) of adjusting the cleaner erase lamp based upon the potential measured in step (f).

5. The method of operating a printing machine according to claim 1, wherein the cleaner erase lamp of step (e) is an illumination-producing cleaner erase lamp.

6. The method of operating a printing machine according to claim 5, further including a step (d) of adjusting the cleaner erase lamp based upon the potential measured in step (c).

7. The method of operating a printing machine according to claim 5, further comprising the steps of:

(g) irradiating the second test patch after step (d) with ions from a cleaning corona source; and (h) measuring the potential of the second test patch after step (g).

8. The method of operating a printing machine according to claim 7, further including a step (g) of adjusting the cleaning corona source based upon the potential measured in step (f).

9. A method of diagnosing a printing machine, comprising the steps of:

(a) producing a known potential on a test patch;

(b) advancing the test patch past an operating transfer station and past a cleaning station; and (c) measuring the potential of the test patch image after step (b);

(d) determining whether the cleaning station is functional based upon the potential measured in step (c); and (e) producing a second known potential on a second test patch;

(f) illuminating the second test patch after step (d) with light from a cleaner erase lamp; and (g) measuring the potential of the second test patch after step (e).

10. The method of diagnosing a printing machine according to claim 9, wherein the cleaning station is a corona source.

11. The method of diagnosing a printing machine according to claim 9, wherein the cleaning station is a cleaning erase lamp.

12. A printing machine including:

means for producing a first known potential on a first test patch;

means for advancing the first test patch past an operating transfer station and past a cleaning station;

means for measuring the potential of the first test patch after the first test patch has been advanced past the operating transfer station and past the cleaning station;

means for producing a second known potential on a second test patch;

means for illuminating the second test patch after with light from a cleaner erase lamp after the second known potential has been produced on the second test patch; and means for measuring the potential of the second test patch after the second test patch has been illuminated.

13. The printing machine of claim 12 wherein the cleaning station is an ion-producing corona source.

14. The printing machine of claim 13 further including means for adjusting the corona source based upon the potential measured by the means for measuring the potential of the first test patch.

15. The printing machine of claim 12 further including means for adjusting the cleaner erase lamp based upon the potential measured by the means for measuring the potential of the first test patch.

16. The printing machine of claim 12 wherein the cleaner erase lamp is an illumination-producing cleaner erase lamp.

17. The printing machine of claim 16 further including means for adjusting the cleaner erase lamp based upon the potential measured by the means for measuring the potential of the first test patch.

18. The printing machine of claim 16 further including:

means for irradiating the second test patch after with ions from a cleaning corona source after the second known potential has been produced on second test patch; and means for measuring the potential of the second test patch after the second test patch has been irradiated with ions.

* * * * *